US006634970B2

(12) United States Patent
Jiminez

(10) Patent No.: US 6,634,970 B2
(45) Date of Patent: Oct. 21, 2003

(54) BASKETBALL WITH REMOVABLE RINGS

(76) Inventor: Juan M. Jiminez, 11310 Hylander Dr., Houston, TX (US) 77070

( * ) Notice: Subject to any disclaimer, the term of this patent is extended or adjusted under 35 U.S.C. 154(b) by 0 days.

(21) Appl. No.: 09/941,900

(22) Filed: Aug. 30, 2001

(65) Prior Publication Data

US 2003/0045383 A1 Mar. 6, 2003

(51) Int. Cl.[7] ..... A63B 41/08
(52) U.S. Cl. ..... 473/597; 473/599; 473/604
(58) Field of Search ..... 473/603, 604, 473/614, 573, 576, 595, 570, 596, 597, 607, 609; 273/DIG. 24

(56) References Cited

U.S. PATENT DOCUMENTS 1,559,117 A * 10/1925 Maynard ..... 473/596
2,149,465 A * 3/1939 Riddell ..... 473/604
2,194,674 A * 3/1940 Riddell ..... 473/597
4,029,316 A * 6/1977 Clarke ..... 473/573
5,403,000 A * 4/1995 Woosley ..... 273/DIG. 24
5,683,316 A * 11/1997 Campbell ..... 473/570
5,851,161 A * 12/1998 Sassak ..... 473/596
5,931,752 A * 8/1999 Guenther et al. ..... 473/597

* cited by examiner

*Primary Examiner*—Steven Wong
(74) *Attorney, Agent, or Firm*—Harrison & Egbert

(57) ABSTRACT

A basketball apparatus having a ball body with a plurality of slots extending circumferentially around the ball body and a plurality of elastic rings removably received within the plurality of slots. The plurality of elastic rings extend circumferentially around the ball body. The ball body has a first pole area and a second pole area. Each of the elastic rings has a thickness at the pole areas that is less than a thickness between the pole areas. Each of the elastic rings extends outwardly of the outer surface of the ball body. Each of the plurality of elastic rings has a textured outer surface.

16 Claims, 3 Drawing Sheets

BASKETBALL WITH REMOVABLE RINGS

BACKGROUND OF THE INVENTION

1. Technical Field of the Invention

The present invention relates to basketballs. More particularly, the present invention relates to basketballs that have protruding portions extending around the circumference of the basketball.

2. Description of the Prior Art

Game balls, such as basketballs, conventionally include an inflatable bladder and a cover. The bladder may be reinforced with windings of nylon thread, polyester thread, etc. The cover is conventionally formed from panels of cover material, for example, leather, synthetic leather or rubber. Adjacent panels are separated by rubber channels.

The portion of the ball excluding the cover is conventionally referred to as the carcass. Historically, basketballs have been made by first forming an inflatable rubber bladder, inflating the bladder and molding the bladder under heat and pressure to vulcanize the rubber. After the bladder is removed from the mold, the bladder is wound with reinforcing thread which forms a layer of windings. The thread may be dipped in latex or adhesive. Pieces of rubber are then laid over the round bladder, and the rubber-covered wound bladder is molded under heat and pressure to vulcanize or cure the pieces of rubber and to fuse the pieces of rubber to each other and to the layers of winding. The molded product is the carcass.

The surface of the carcass mold is provided with grooves which form upwardly extending projections on the surface of the carcass. The projections will form the seams or channels of the completed ball. The portions of the carcass between the channels are spherical. Panels of cover material are laid into the areas of the carcass between the channels, and adhesive may be applied to the cover channels and/or the carcass. The covered carcass is placed in a mold having the shape of a completed ball to form the ball under heat and pressure.

The seams formed between the sections of material on the cover of the basketball are indented from the exterior surface of the basketball. These indented seams are somewhat convenient for the gripping of the basketball. More importantly, these seams can provide an indication to the user of the proper rotation applied to the basketball. Ultimately, since the seams are indented, they will not wear as quickly as the exterior surface of the basketball.

In the past, various patents have issued relating to various types of seams associated with game balls. U.S. Pat. No. 3,512,777, issued on May 19, 1970 to R. B. Henderson, teaches the molding of raised edges around a basketballs circumference so as to facilitate the gripping of the basketball. The ridge extends outwardly of the seam of the basketball. These seams constitute a single piece of molded material. It is stated in the patent that a player is given the opportunity to feel, with his fingertips, the projecting edges of the seam which enables the player to handle the ball more effectively than when the entire ball is completely spherical and has no seams of any kind.

U.S. Pat. No. 6,123,633, issued on Sep. 26, 2000 to Guenther et al., teaches an inflatable game ball with a lobular carcass and a relatively thin cover. This patent describes the molding of a raised ridge around the outer diameter of the basketball. A portion of the seams extends outwardly so to be slightly raised above the exterior surface of the basketball so as to facilitate the gripping of the basketball.

U.S. Pat. No. 3,475,027, issued on Oct. 28, 1969 so R. B. Henderson, describes an athletic game ball which has a raised ridge around the seam of the ball in order to facilitate the handling and gripping characteristics of the ball. This raised ridge has a height which is elevated above the surface of the basketball and extends from the seam. The use of this seam profile allows the player to readily locate the raised surfaces with his or her fingertips without having to direct the player's vision to the ball. As a result, the player can quickly obtain a secure grip on the ball and exercise greater control and accuracy in handling and throwing the ball.

U.S. Pat. No. 6,203,795, issued on May 27, 2001 to T. M. Ou, U.S. Pat. No. 1,098,384, issued on Jun. 2, 1914 to L. T. Hoffman and U.S. Pat. No. 6,099,423, issued on Aug. 8, 2000 to T. M. Ou, each show raised ridges around the seams of the basketball for the purpose of facilitating the feel and grip characteristics of the basketball.

Although these prior art patents describe the molding of raised edges along the seams of the basketball, these raised edges will quickly deteriorate with use. Since they are actually molded into the basketball, it is not possible to replace or remove such seams. Additionally, these raised seams extend only slightly outwardly of the outer surface of the basketball. There is less of a true gripping surface than if the raised surface extended out further from the exterior surface of the basketball. The molding of the raised seams does not allow a person to properly customize the basketball for his or her purposes.

It is an object of the present invention to provide elastic rings for a basketball which resist slippage of the basketball from the hands of the players.

It is another object of the present invention to provide a basketball with elastic rings that facilitates the ability to palm the basketball.

It is another object of the present invention to provide a basketball with elastic rings that provides better traction and feel for the basketball.

It is another object of the present invention to provide a basketball with elastic rings which allows the rings to be replaced when they wear out.

It is a further object of the present invention to provide a basketball with elastic rings that allows the user to customize the appearance of the basketball.

It is a further object of the present invention to provide a basketball with elastic rings that can allow for the illumination of the rings under nighttime playing conditions.

It is still a further object of the present invention to provide a basketball with elastic rings that will enhance the eye/hand coordination of the user.

It is still a further object of the present invention to provide a basketball with rings that will provide better visual perception of spin of the basketball and enhance shooting techniques.

These and other objects and advantages of the present invention will become apparent from a reading of the attached specification and appended claims.

BRIEF SUMMARY OF THE INVENTION

The present invention is a basketball apparatus comprising a ball body having a plurality of slots extending circumferentially around the ball body and a plurality of elastic rings removably received within the respective plurality of slots. The plurality of elastic rings extends circumferentially around the ball body.

In the preferred embodiment of the present invention, three slots extend circumferentially around the ball body.

Alternatively, a total of four slots can extend circumferentially around the ball body.

The ball body includes a first pole area and a second pole area opposite to the first pole area. The plurality of elastic rings are in overlapping relationship at the first and second pole areas. Each of the plurality of elastic rings has a thickness at the pole area that is less than a thickness of the elastic rings between the pole areas. The thickness of the elastic rings at the first and second pole areas is approximately 1/Nth of the thickness of the elastic rings between the pole areas in which N is equal to the number of elastic rings. Each of the plurality of elastic rings has an outward surface extending outwardly beyond an outer surface of the ball body. This outer surface of the elastic rings extends outwardly of the outer surface of the ball body by approximately ⅛ inch. Each of the slots is equally radially spaced from an adjacent slots. Each of the plurality of slots extend into the ball body to a depth from an outer surface of the ball body. Each of the plurality of slots has a generally flat surface at a bottom thereof. Each of the plurality of slots has walls which taper so as to narrow from the outer surface of the ball body toward the bottom of the slot. The bottom of each of the slots has a width of approximately ¼ inch. Each of the plurality of slots at the outer surface has a width of ½ inch.

Each of the plurality of elastic rings has a textured outer surface extending outwardly of the outer surface of the ball body. This textured outer surface can be a plurality of ribs extending in parallel relationship to each other around the circumference of the elastic ring, a plurality of convolutions extending around the circumference of the elastic ring, or a thread pattern extending around the circumference of the elastic ring. Each of the elastic rings can also include a chemiluminescent, phosphorescent or fluorescent material.

DETAILED DESCRIPTION OF THE INVENTION

Figure 1:
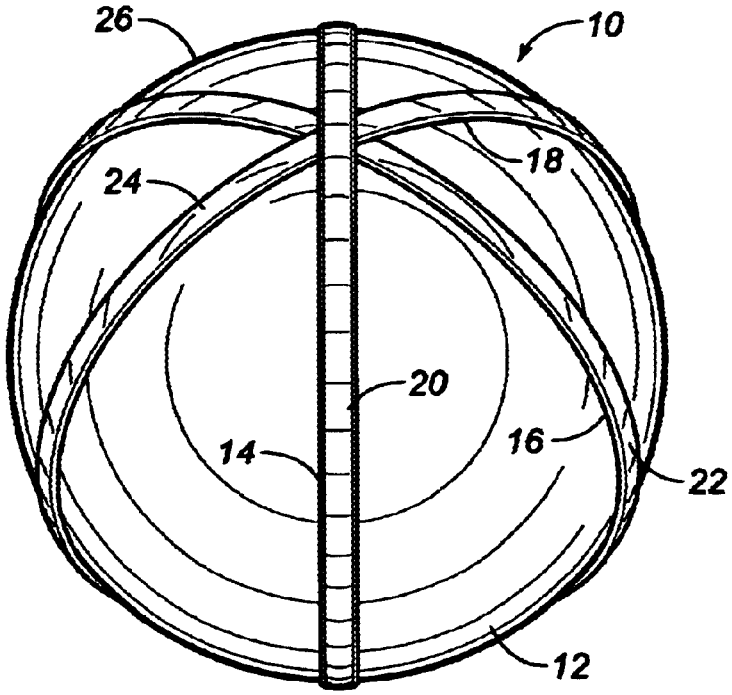
FIG. 1 is a perspective view of the apparatus in accordance with the teachings of the present application of the present invention.

Referring to FIG. 1, there is shown at 10 the basketball apparatus in accordance with the teachings of the present invention. The basketball apparatus includes an inflatable ball body 12 of a generally spherical configuration. A plurality of slots 14, 16 and 18 are formed in the ball body 12 and extend circumferentially therearound. A plurality of elastic rings 20, 22 and 24 are removably received within the respective slots 14, 16 and 18 so as to extending circumferentially around the ball body. As can be seen in FIG. 1, a total of three elastic rings are respectively received within the slots 14, 16 and 18.

The placement of the elastic rings 20, 22 and 24 within the slots 14, 16 and 18, respectively, will cause an outer surface of the respective rings to protrude outwardly of the outer surface 26 of the ball body 12. This outwardly projecting surface will provide the user with a better ability to palm the basketball and provide the user with better traction. In the event that the elastic rings 20, 22 and 24 should become worn from extensive use, they can be easily removed from the respective slots 14, 16 and 18 and replaced with different rings. Alternatively, the rings 20, 22 and 24 can be formed of different colors or patterns so as to allow the customer to customize the basketball 10. In particular, if the rings 20, 22 and 24 are formed of a fluorescent or phosphorescent material, the basketball 10 can be used effectively under dim light or nighttime conditions. The easily visible elastic rings 20, 22 and 24 facilitate eye/hand coordination of the user and also apply a better visual perception of spin as applied to the basketball. Since each of the rings 20, 22 and 24 extends outwardly beyond the outer surface 26 of the ball body 12, the user can apply greater spin to the basketball than would be otherwise applied and can enhance the shooting technique of the user.

Figure 2:
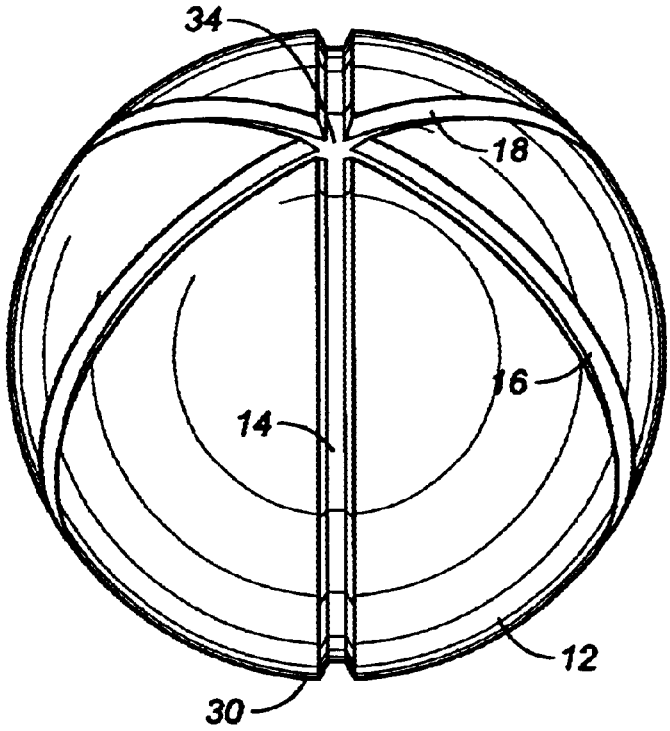
FIG. 2 is a perspective view of the apparatus of the present invention showing the ball body without the elastic rings attached.

FIG. 2 illustrates the ball body 12 showing, in particular, the slots 14, 16 and 18 without the respective rings therein. It can be seen that the slots 14, 16 and 18 extend circumferentially around the ball body 12. A first pole area 28 is formed on the top of the basketball. A similar pole area 30 will be formed at the bottom of the basketball 10. The first pole area 28 is opposite in location to the second pole area 30. Each of the pole areas 28 and 30 will have a similar configuration. The pole areas 28 and 30 are specially configured so that the elastic rings 20, 22 and 24 can overlap with each other in such areas without creating an unbalanced effect to the basketball. The pole areas 28 and 30 will have a diameter of approximately two inches.

Figure 3:
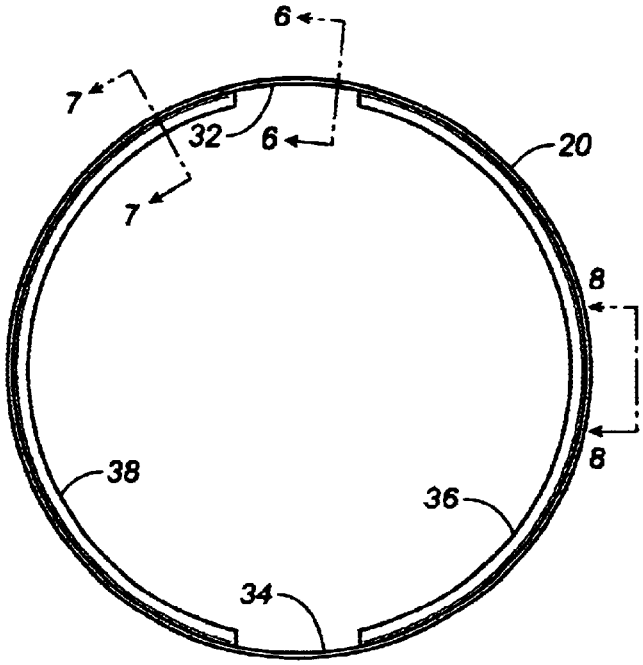
FIG. 3 is an isolated side view of an elastic ring as used in the apparatus of the present invention.

FIG. 3 is an isolated view of elastic ring 20. In FIG. 3, it can be seen that the elastic ring 20 has a generally circular configuration. Ring 20 has a narrowed thickness at the top section 32 and a narrowed thickness at the bottom surface 34. The thickness of the elastic ring 20 between the top section 32 and the bottom section 34 is of greater thickness than these "pole" sections. In normal use, the top section 32 will be placed into the first pole area 28 of the ball body 12 and the lower section 34 will be placed into the pole area 30 of ball body 12. Since each of the rings, 20, 22 and 24 must overlap in the respective pole areas 28 and 30, the sections 32 and 34 of narrowed thickness are necessary so that the diameter of the ball body 12 will be of consistent thickness in the pole areas 28 and 30. As such the present invention solves the problem of the overlapping rings in such pole areas.

Figure 6:
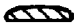
FIG. 6 is a cross-sectional view taken across lines 6—6 of FIG. 3.
Figure 7:
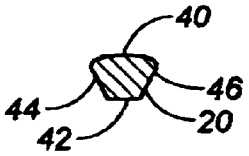
FIG. 7 is a cross-sectional view of the elastic rings as taken across lines 7—7 of FIG. 3.

The narrowed thickness at sections 32 and 34 will be approximately ⅛ inch thick. The sides 36 and 38 of will be approximately 7⁄16 inch thick. Fundamentally, the narrowed thickness of sections 32 and 34 will be 1/nth of the thickness of the sides 36 and 38 in which N is equal to the number of elastic rings that are used. FIG. 6 shows a cross-sectional view of the top section 32 located within the pole area 28 of the ball body 12. FIG. 7 shows a cross-sectional view of the side section 38 of greater thickness. In particular, in FIG. 7, it can be seen that the elastic ring 20 has an outer surface 40 and a flat interior surface 42. Outer surface 40 will be positioned so as to protrude outwardly of the outer surface 26 of the ball body 12. Sides 44 and 46 will taper so as to narrow from the outer surface 40 to the flat interior surface 42. As a result of this configuration, the elastic rings 20 will fit within slot 14 in a non-slip condition. The angled side walls 44 and 46 will create a suitable "wedge" effect so that the ring 20 is effectively retained within its respective slot. The elastic rings 20 will not be dislodged during conventional play.

Figure 8:
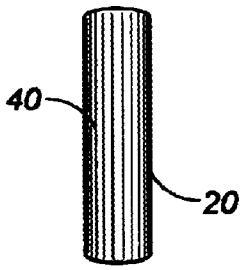
FIG. 8 is a detailed view taken between lines 8—8 of FIG. 3.

FIG. 8 shows the texture of the outer surface 40 of the ring 20. As can be seen in FIG. 8, the textured outer surface 40 has a plurality of ribs which extending circumferentially around the elastic ring 20. These ribs enhance the ability to "feel" the basketball 10 and, in particular, the elastic ring 20.

Figure 4:
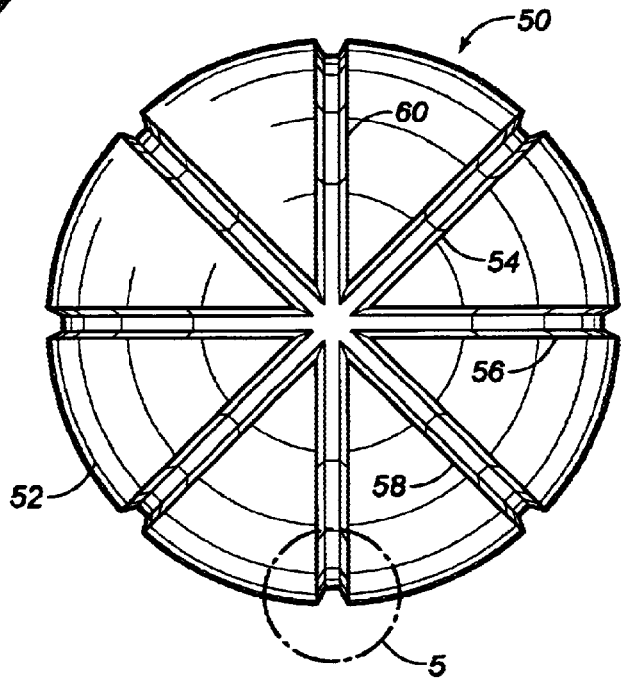
FIG. 4 is a plan view showing an alternative embodiment of the ball body as used with the apparatus of the present invention.

FIG. 4 shows a view of an alternative embodiment of basketball 50. Basketball 50 has a ball body 52 and a plurality of slots 54, 56, 58 and 60 extending circumferentially around the ball body 52. Each of the slots 54, 56, 58 and 60 has a configuration similar to the slots shown in 52. However, in this alternative embodiment of the present invention, a total of four slots extend around the ball body 52.

Figure 5:
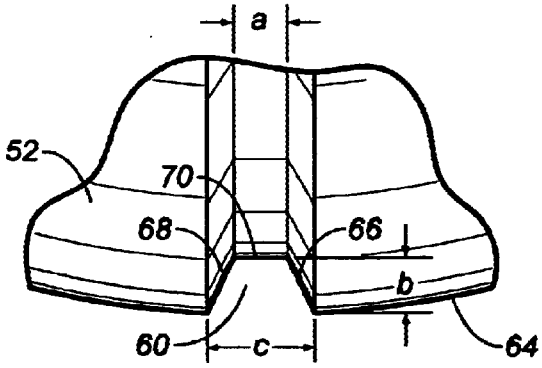
FIG. 5 is a detailed view of circled area 5 of FIG. 4.

FIG. 5 is a detailed view of the circled area 5 in FIG. 4. In FIG. 5, the interior configuration of slot 60 is particularly illustrated. Slot 60 opens to the outer surface 64 of the ball body 52. Slot 60 has slide walls 66 and 68 which taper inwardly from the outer surface 64 to the flat interior surface 70 of the slot 60. Side walls 66 and 68 taper so as to narrow inwardly from the outer surface 64 toward the flat surface 70. The flat interior surface has a width dimension a of approximately ¼ inch. The slot 60 has a depth dimension b of approximately 5⁄16 inch. The opening of the slot 60 at the outer surface 64 of the ball body 52 has a width dimension c of ½ inch. Slot 60 is of an identical configuration to those of the slots 14, 16 and 18 as shown on the ball body 12 of FIG. 2.

Figure 9:
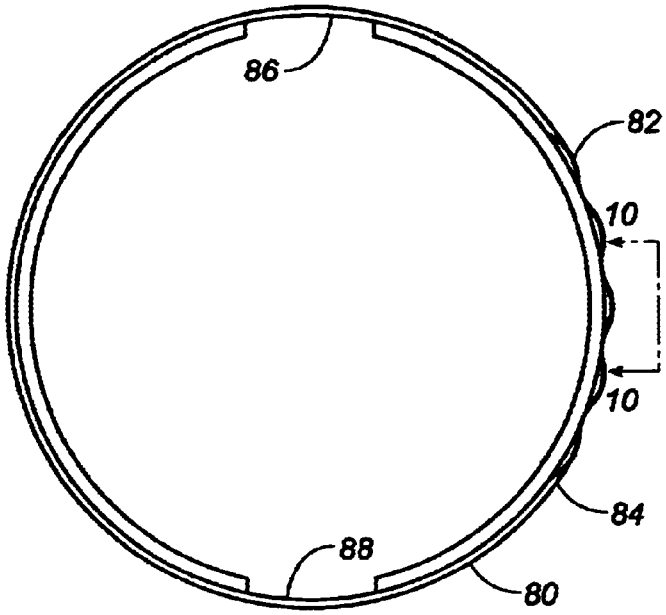
FIG. 9 is a side elevational view of an alternative embodiment of the elastic ring of the present invention.
Figure 10:
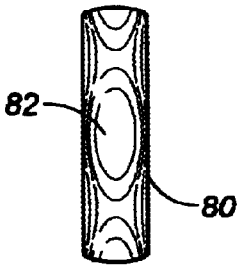
FIG. 10 is a detailed view taken between lines 10—10 of FIG. 9.

FIG. 9 shows an alternative embodiment of ring member 80. In particular, ring member 80 has convolutions 82 formed on its outer surface 84. Convolutions 82 will extend around a portion of the circumference of the elastic ring 80. It can be seen that the elastic ring 80 includes top section 86 and bottom section 88 of reduced thickness. FIG. 10 is a close-up view showing the convolutions 82 formed on the elastic ring 80.

Figure 12:
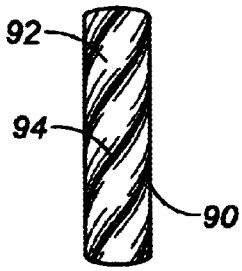
FIG. 12 is a close-up view taken between lines 12—12 of FIG. 11.
Figure 11:
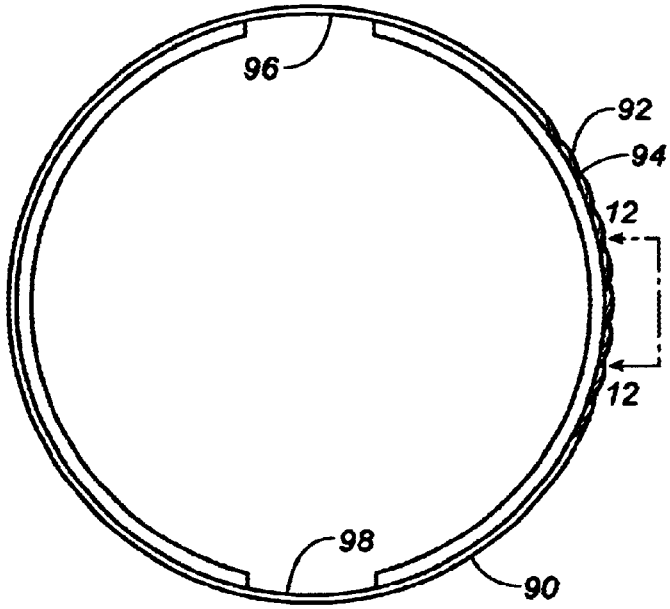
FIG. 11 is a side elevational view of a second alternative embodiment of the elastic ring as used in the present invention.

FIG. 11 is a second alternative embodiment of the ring member 90. Ring member 90 has a textured exterior surface 92 having a generally spiral pattern 94. Elastic ring 90 has upper section 96 and lower section 98 of reduced diameter. FIG. 12 is a close-up view showing the thread pattern 94 as applied to the textured exterior surface 92 of elastic ring 90.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. An apparatus comprising:

a basketball body having a plurality of slots each extending circumferentially around said body; and a plurality of elastic rings removably received respectively within said plurality of slots, each of said plurality of elastic rings extending circumferentially around said body, each of said plurality of elastic rings having an outer surface extending outwardly beyond an outer surface of said body.

2. The apparatus of claim 1, said plurality of slots being three slots extending circumferentially around said body.

3. The apparatus of claim 1, said plurality of slots being four slots extending circumferentially around said body.

4. An apparatus comprising:

a basketball body having a plurality of slots each extending circumferentially around said body; and a plurality of elastic rings removably received respectively within said plurality of slots, each of said plurality of elastic rings extending circumferentially around said body, each of said plurality of elastic rings having an outer surface extending outwardly beyond an outer surface of said body, said body having a first pole area and a second pole area opposite to said first pole area, said plurality of plastic rings being in overlapping relationship at said first and second pole areas.

5. The apparatus of claim 4, each of said plurality of elastic rings having a thickness at said first and second pole areas that is less than a thickness of said plurality of elastic rings between said first and second pole areas.

6. The apparatus of claim 5, said thickness at said first and second pole areas being approximately 1/Nth of said thickness between said first and second pole areas where N is equal to a total number of said plurality of elastic rings.

7. The apparatus of claim 1, said outer surface of each of said plurality of elastic rings extending outwardly of said outer surface of said body by approximately ⅛ of an inch.

8. The apparatus of claim 1 said plurality of slots being spaced radially equally from each other.

9. The apparatus of claim 1, each of said plurality of slots extending into said body to a depth from an outer surface of said body, each of said plurality of slots having a generally flat surface at a bottom thereof.

10. The apparatus of claim 9 each of said plurality of slots having walls tapering so as to narrow from said outer surface toward said bottom.

11. The apparatus of claim 10 said bottom of each of said plurality of slots having a width of ¼ inch, each of said plurality of slots at said outer surface having a width of ½ inch.

12. An apparatus comprising:

a basketball body having a plurality of slots each extending circumferentially around said body; and a plurality of elastic rings removably received respectively within said plurality of slots, each of said plurality of elastic rings extending circumferentially around said body, each of said plurality of elastic rings having an outer surface extending outwardly beyond an outer surface of said body, each of said plurality of elastic rings having a textured surface extending outwardly of said outer surface of said body.

13. The apparatus of claim 12, said textured outer surface comprising a plurality of ribs extending in parallel relationship to each other around a circumference of the elastic ring.

14. The apparatus of claim 12, said textured outer surface comprising convolutions extending around a circumference of each of said plurality of elastic rings.

15. The apparatus of claim 12, said textured outer surface comprising a thread pattern extending around a circumference of each of said plurality of elastic rings.

16. The apparatus of claim 1, each of said plurality of elastic rings having a phosphorescent or fluorescent material therein.

* * * * *